United States Patent [19]

Colli et al.

[11] Patent Number: 4,964,581

[45] Date of Patent: Oct. 23, 1990

[54] BOBBIN WINDING METHOD COMPRISING VARIABLE-DURATION INTERVENTIONS FOR RESTORING YARN CONTINUITY, AND DEVICES FOR ITS IMPLEMENTATION

[75] Inventors: Luigi Colli; Roberto Badiali; Nereo Marangone, all of Pordenone, Italy

[73] Assignee: Savio, S.p.A., Pordenone, Italy

[21] Appl. No.: 254,406

[22] Filed: Oct. 6, 1988

[30] Foreign Application Priority Data

Nov. 13, 1987 [IT] Italy ..... 22623 A/87

[51] Int. Cl.[5] ..... B65H 54/22

[52] U.S. Cl. ..... 242/35.6 R

[58] Field of Search ..... 242/35.6 R, 36, 39, 242/35.5 R, 35.5 A; 57/263

[56] References Cited

U.S. PATENT DOCUMENTS

| | | | |
|---|---|---|---|
| 2,752,103 | 6/1956 | Fürst | 242/36 |
| 3,380,677 | 4/1968 | Stapfer | 242/35.5 R |
| 3,739,996 | 9/1973 | Matsui et al. | 242/39 |
| 4,163,358 | 8/1979 | Takeuchi et al. | 57/78 |
| 4,195,790 | 4/1980 | Reiners et al. | 242/35.6 R X |
| 4,228,642 | 10/1980 | Dakin et al. | 57/263 |
| 4,232,508 | 11/1980 | Husges et al. | 57/263 X |
| 4,319,720 | 3/1982 | Ueda | 242/35.6 R X |
| 4,631,682 | 12/1986 | Ng et al. | 242/36 X |
| 4,635,866 | 1/1987 | Kamp et al. | 242/39 |

FOREIGN PATENT DOCUMENTS 1375596 6/1973 France .

*Primary Examiner*—Stanley N. Gilreath

*Attorney, Agent, or Firm*—Hedman, Gibson, Costigan & Hoare

[57] ABSTRACT

An improved bobbin winding method comprising variable-duration interventions for restoring yarn continuity which are implemented in accordance with a cycle divided into a first bobbin braking part and a second yarn joining part. Between the commencement of the two parts of the cycle there is interposed a delay the duration of which varies as a function of the angular displacement of the bobbin carrier arm.

12 Claims, 5 Drawing Sheets

Development of bobbin stoppage times at different winding speeds as a function of the rotation angle of the bobbin carrying arm

BOBBIN WINDING METHOD COMPRISING VARIABLE-DURATION INTERVENTIONS FOR RESTORING YARN CONTINUITY, AND DEVICES FOR ITS IMPLEMENTATION

This application is related to commonly assigned applications by Luigi Colli et al. for Improved Method of Restoring Yarn Continuity During Bobbin Winding And Devices For Its Implementation, Ser. No. 246,411, filed Sept. 19, 1988; Improved Bobbin Winding Method And Devices For Implementing Said Method, Ser. No. 258,372, filed Oct. 17, 1988; and High Productivity Bobbin Winding Method And Devices For Its Implementation, Ser. No. 256,776, filed Oct. 11, 1988.

FIELD OF THE INVENTION

This invention relates to an improved winding method and devices for implementing said improved winding method. The improvement according to the invention enables the productivity of the winding operation to be increased and unproductive times to be shortened.

BACKGROUND OF THE INVENTION

The winding operation consists substantially of transferring the yarn from a starting package and winding it on a rigid tube in order to form a structure wound in the form of cross turns and known as a bobbin, and during said transfer clearing the yarn of its imperfections and defects such as lumps, groups, naps, weak points, flocks etc. Said defects are eliminated by cutting out the defective portion and joining the yarn ends.

This joint can be made either by a proper knot such as a fishermans knot or a weavers knot produced by a mechanical knotter, or by a pneumatic or friction joint in which the fibres of the cut ends are untwisted, intermixed and then retwisted to thus restore continuity to the cut yarn without introducing the hardly relevant irregularity represented by a actual knot. The removing of the yarn defects is commonly known as yarn clearing in that the defect is detected by a yarn clearer which is sensitive to yarn defects and can either itself break the continuity of the yarn or operate a separate cutting member. Any discontinuity in the yarn causes the bobbin to undergo braking so that it stops, the yarn ends are picked up by mobile suckers and moved to the joining devices or knotters, the joined yarn is returned to its normal position and winding is recommenced, the bobbin and its drive roller being driven up from rest to the operating speed, which is generally of 600–1600 m/minute. The winding speed is determined—within the limits of the possible winding machine performance—by the quality and count of the yarn to be wound.

The overall productivity of the operation is determined by the winding speed, the time taken by the overall intervention cycle and the actual number of interventions to be made.

It is therefore apparent that if a certain yarn is wound at a too high speed, the increased productivity resulting from the increase in speed is compromised by the down times deriving from the increase in the number of interventions required to restore the yarn continuity due to the greater number of yarn breakages. The bobbin is normally driven by a rotating roller—of right cylindrical or slightly tapering conical shape—which is kept in contact along a generator common to the two members.

The technical problem to which the present invention relates derives from the fact that during the winding operation the rotating roller does not change its shape or size, whereas the bobbin continuously changes its size due to the increasing amount of yarn wound on it.

If the drive takes place under perfect friction, the peripheral speed of the drive roller is substantially equal to the linear winding speed of the yarn.

As the size of the bobbin increases, the linear yarn winding speed is kept substantially constant—this being a necessary condition for proper outcome of the operation—but the angular speed of the bobbin decreases linearly.

During the formation of the bobbin, this acquires continuously increasing inertia because of its increase in mass and its progressive distancing from the axis of rotation.

The first stage in the invention cycle which commences with the cutting or tearing of the yarn by the passage of a defective portion through the yarn clearer is the braking of the bobbin so that its speed decreases to zero.

The brake must therefore absorb the kinetic energy possessed by the rotating bobbin, and its stoppage time is substantially proportional to said kinetic energy.

Generally, the bobbin is braked by a mechanical shoe brake—or equivalent type—operated by pressurised fluid such as compressed air, which is distributed by a solenoid valve which operates following the yarn discontinuity signal.

The drive roller is provided with its own braking devices, such as an inverter acting on its drive motor. To prevent damage to the bobbin it is desirable that the two braking actions take place independently, by withdrawing the bobbin and roller away from each other when the yarn discontinuity signal occurs at the commencement of the intervention cycle.

The operations subsequent to the stoppage can take place only when the bobbin is properly at rest.

In the known art the intervention cycle is effected as shown in the scheme of FIG. 1.

The duration of the intervention cycle is fixed and is divided into a fixed time available for stoppage and a fixed time for executing the other operations to be carried out during the intervention. After the stoppage time has passed, the bobbin must be completely at rest because otherwise the other intervention operations cannot be properly carried out, for instance it would be impossible to grip the end of the yarn on the bobbin side if this is still rotating.

The drive and control unit for the members which sequentially carry out the various operations of the intervention cycle is a mechanical system—such as a shaft provided with a series of cams so that when rotated, said cams sequentially encounter the drives for the various members, which consequently operate in sequence—or an equivalent electrical control system.

In this arrangement, the various intervention operations are performed sequentially by various members operated in accordance with a program of operation initiation times which are rigid and cannot be changed.

To be more precise, it should be noted that certain preliminary operations, such as moving the suckers into the correct position for seeking and picking up the yarn ends, these suckers being in their rest position at the commencement of the intervention cycle, can commence while the bobbin is still moving, but the actual operations of the intervention cycle subsequent to braking can only commence when the bobbin is at rest.

If the bobbins to be produced are small or if the operating speed is low, the time taken by those preliminary operations which can be carried out while the bobbin is still moving is longer than the bobbin stoppage time, and there are therefore no problems. The fixed time allowed for bobbin stoppage must therefore correspond to the time required for absorbing the maximum kinetic energy which the bobbin can possess, and thus to its maximum possible winding speed, its maximum possible size and its maximum possible density. This time must then be increased by a certain safety margin to take account of any reduction in the efficiency of the braking system.

The current tendency in bobbin production is to increase winding speed and to maintain it when producing large-diameter bobbins. It is apparent that the criterion of assigning a fixed available time for bobbin stoppage based on the maximum kinetic energy which it can assume leads in most cases to a considerable time wastage because this fixed assigned time is necessary only when the bobbin has reached its maximum scheduled size and rotates at the maximum speed scheduled for this size.

This is very important because this time wastage—even if only of the order of a few seconds—is repeated during every intervention cycle for restoring yarn continuity, and this cycle can take place hundreds of times.

The deriving technical problem which the present invention solves is to assign a bobbin stoppage time within the intervention cycle which is no longer fixed but is variable, and increases with the progress of the bobbin under formation.

SUMMARY OF THE INVENTION

The present invention therefore is directed to an improved winding method and devices for its implementation. It includes three essential component parts:

dividing the intervention cycle—and the control devices which implement it—into two separate parts, a first part for at least braking and stopping the bobbin and directly relating to discontinuity in the wound yarn (and hereinafter called simply braking) and a second part for at least the further stages of the intervention cycle which have to be carried out when the bobbin is at rest (and hereinafter called simply joining), and interposing between the commencement of the stages involved in the two parts a variable delay which is to be determined at any given time, and is implemented by a timer device which controls the commencement of joining with a time displacement corrsponding to said delay;

measuring the state of progress in the formation of the bobbin identifying the delay to be assigned on the basis of the state of progress in the formation of the bobbin, and transmitting this information to the timer device which implements this delay between the commencement of braking and the commencement of joining.

DESCRIPTION OF THE PREFERRED EMBODIMENT

Figure 1:
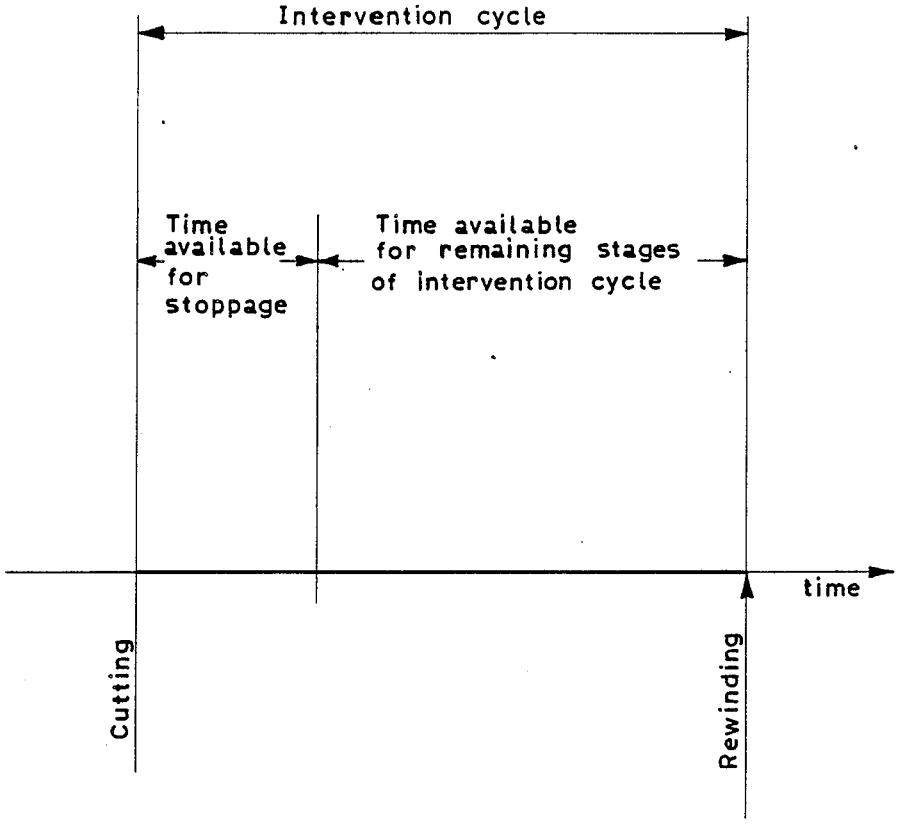
Fig.1 PRIOR ART
FIG. 1 is a graphical illustration of the prior art.

The characteristics of the three essential parts of the present invention will now be described commencing with the division of the intervention cycle and its control devices. The first part of the intervention cycle, which commences on receipt of a signal indicating yarn discontinuity—either because it has been cut intentionally by the yarn clearer, or because it has broken naturally or because the feed package is empty—consists of the following main stages:

raising the bobbin away from the drive drum braking the bobbin braking the drive roller.

All these three operations are related to each other and are controlled either electrically, for example by means of a solenoid valve operating with compressed air, or mechanically by means of a rotary shaft provided with cams. The various operations concerned and the devices which implement them proceed without rigid time relationship with the second part of the intervention cycle. The second part of the intervention cycle can commence either simultaneously with the first—if no delay instruction has been transmitted by the unit which measures the state of progress of the bobbin—or with a delay in accordance with the instructions from said measurement unit. The second part of the intervention cycle consists of the following main stages:

moving the suckers which seize the yarn ends on the bobbin side and package side;

sensing the presence of yarn;

if there is no yarn present on the package side, operating the package changing devices and, when the package has been changed, seizing the new yarn end on the package side;

disenabling the command which has implemented the first part of the cycle: the brakes are released, and the bobbin and roller are again brought into contact;

reversing the motion of the drive roller for a short time to allow the sucker which seizes the yarn end on the bobbin side to operate with a sufficient length of yarn to reach the knotter;

inserting the yarn ends into the knotter;

operating the knotter to make the joint and then releasing the joined yarn (in the meantime the yarn seizing suckers can return to their rest position);

restarting the drive roller.

These stages of the second part can also be controlled mechanically, for instance by a rotary shaft provided with a series of cams which gradually operate the controls for the devices implementing the aforesaid steps, or by equivalent electrical or electronic devices.

The control members for the first part of the intervention cycle—known hereinafter simply as braking—and the control members for the second part of the intervention cycle—known hereinafter simply a joining—are separated in their operation by an interposed mechanical, electrical or electronic timer device which inserts a delay, or otherwise, between the commencement of braking and the commencement of joining.

The measurement of the state of progress of the bobbin can be based on various quantities such as the length of the yarn wound, the number of revolutions undergone by the bobbin, the useful time which has passed since the commencement of formation the bobbin, or other parameters.

Instead, the present invention measures the bobbin state of progress on the basis of the angular movement of the bobbin carrier arm. This method of measurement is described with reference to FIG. 2, which shows diagrammatically the arrangement of the bobbin carrier arm.

The bobbin under formation 1, the tube of which is engaged between the fixing centres of the bobbin carrier arm 2, rests against the roller 3 which rotates at constant speed driven by the motor 4, by way of a toothed belt drive 5. The bobbin 1 is therefore rotated by the roller 3 and winds the yarn about itself, with gradually increasing diameter.

The effect of this increase is that the axis of rotation of the fixing centres engaged in the tube of the bobbin under formation moves further from the roller 3 and with it the bobbin carrier arm rises upwards moving from a lower position corresponding to the tube empty, to a higher position which continues to rise as the bobbin grows.

Figure 3:
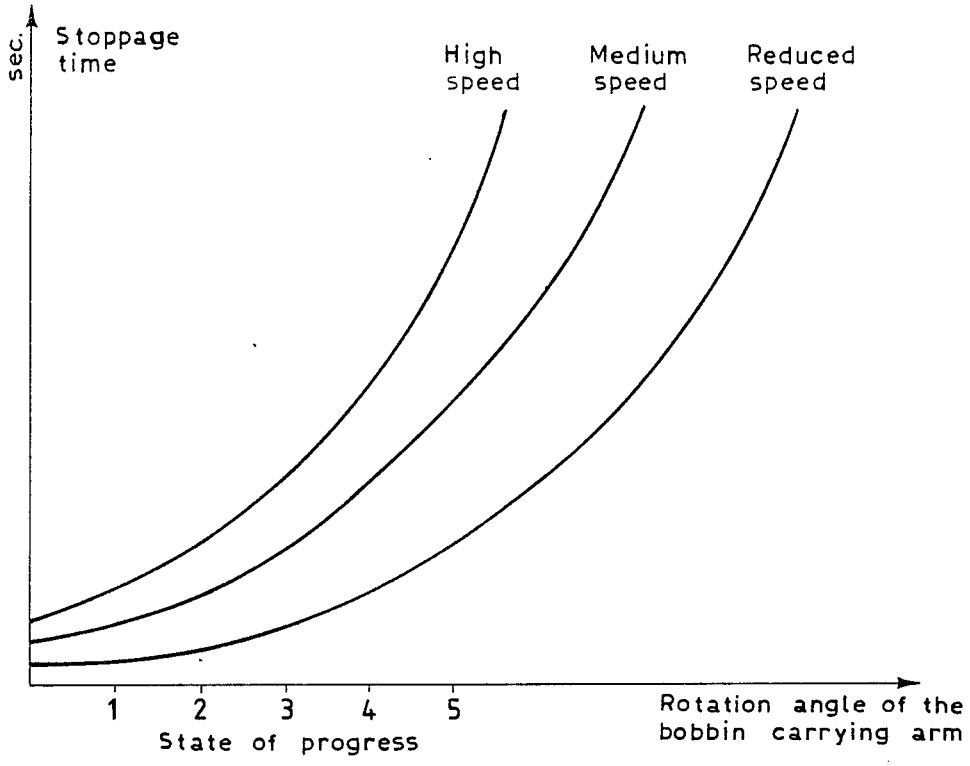
FIG. 3 is a graphical representation of bobbin stoppage times relative to the amount of yarn on the bobbin.

The bobbin carrier arm is hinged on the shaft 6 and rotates about its axis 7 through an angle $\alpha$ in the vertical plane. Measuring $\alpha$ provides an indication of the state of progress of the bobbin, this being substantially equivalent to measuring its radius and is independent of the wound yarn count. The variation in the time required to halt the bobbin as a function of the state of progress of the bobbin is shown in FIG. 3.

According to the present invention the variation in the angle $\alpha$ is measured mechanically by an adjustable cam 8 mounted rigid with the bobbin carrier arm 2.

The outer contour 9 of the cam 8 comprises several portions of substantially constant radius $r_1$, $r_2$ . . . $r_n$, smoothly connected together by increasing radis portions.

As the angle $\alpha$ increases the cam 8 rotates rigidly with the bobbin carrier arm 2 in a clockwise direction and with its outer contour 9 it displaces a mechanical sensor 10 held in contact with said contour 9. Said mechanical sensor 10 determines by its various positions the delays which the timer 11 is to implement between the commencement of braking and the commencement of joining. Said timer 11 can be of mechanical, electrical or electronic type. It is programmed in accordance with a series of delays which increase from zero delay to maximum delay, and correspond to the number of steps provided on the contour 9.

For example, if the following series of times between the commencement of braking and the commencement of joining is set:

2 seconds (not less than the time required by the preliminary joining operations which can be carried out while the bobbin is still moving) corresponding to zero delay, 3 seconds corresponding to a delay of 1 second, 4 seconds corresponding to a delay of 2 seconds, and so on.

Figure 4:
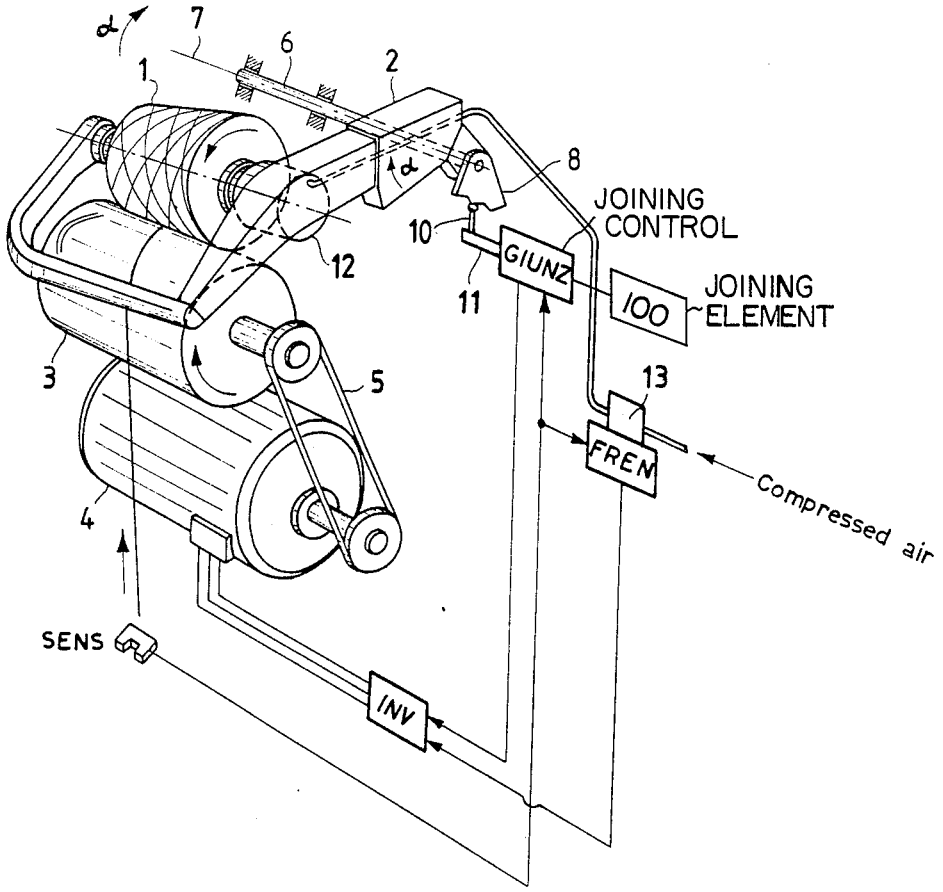
FIG. 4 is an orthogonal diagram of the present invention.

It is apparent that the more the contour 9 of the cam 8 is divided into different radius portions, and the more numerous and close together the terms of the increasing time series, the greater will be the variability of the time displacement between the braking and joining and the greater will be the correspondence between the time left available for halting and the effective time required for the bobbin to come to rest. The characteristics and advantages of the present invention will be more apparent from the description of a typical embodiment given hereinafter with reference to FIG. 4.

The bobbin carrier arm 2 carries in its fixing centres a mechanical brake 12 operated pneumatically by compressed air by means of the solenoid valve 13.

The winding station is provided with a sensor SENS the purpose of which is to sense any break in continuity of the yarn—either by the action of the yarn clearer, or by breakage or because the feed package is empty—and to activate the intervention cycle described heretofore.

When it senses this yarn discontinuity, SENS activates the control FREN the purpose of which is to implement the braking by means of the solenoid valve 13 and the other operations involved in the first part of the intervention cycle, and simultaneously to activate the control GIUNZ, the purpose of which is to implement the second part of the intervention cycle which restores continuity to the yarn by means of joining element 100 and removes the brake applied to the motor by the inverter.

The control GIUNZ is connected to the timer 11, which as the angle $\alpha$ varies delays the commencement of the second part of the intervention cycle by the extent of the particular "step" of the contour 9 in contact wit the sensor 10.

Figure 5:
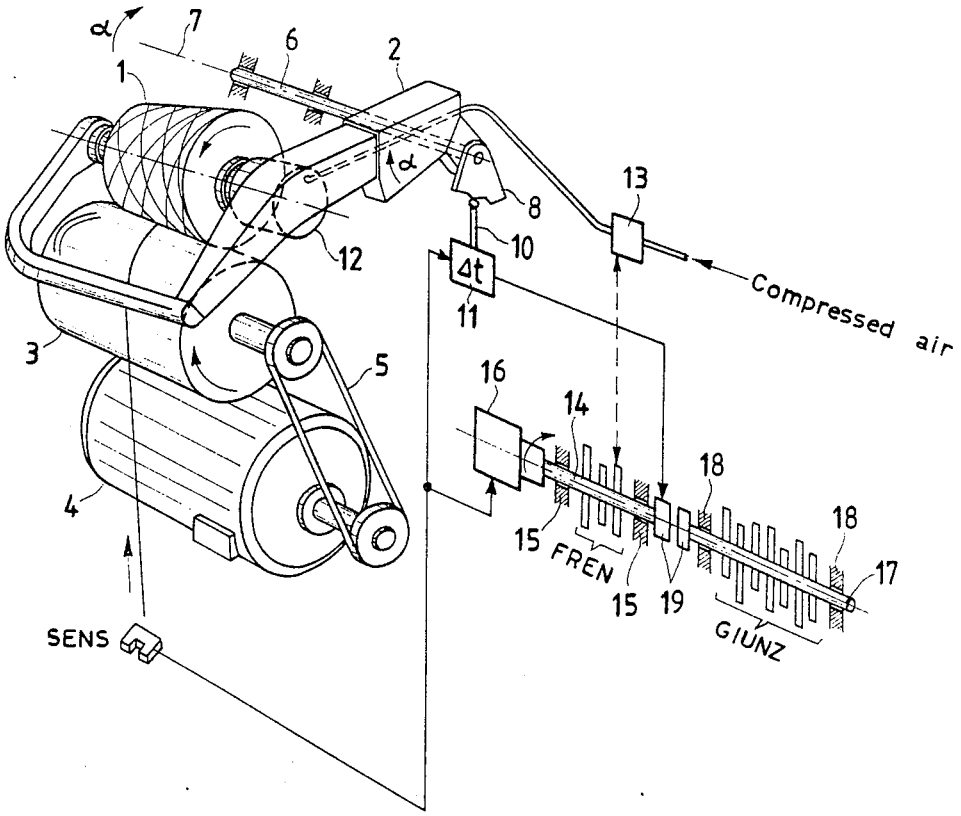
FIG. 5 is an orthogonal diagram of another representation of the present invention showing the shafts and cams which operate the first and second portions of the intervention cycle.

FIG. 5 shows an electromechanical embodiment of the present invention by way of example.

The first part of the intervention cycle—the braking—is controlled by the shaft 14 which carries a series of cams for operating the members which effect the braking. One of said cams operates the valve 13.

Said rotary shaft 14 is supported by bearings 15 and driven by a geared motor 16.

The second part of the intervention cycle—the joining—is controlled by the shaft 17, which carries a series of cams for operating the members which effect the joining.

Said rotary shaft 17 is supported by bearings 18 and is coaxial to the shaft 14, to which it is connected by the electromagnetic clutch 19, which can make the shaft 17 idle or rigid with the shaft 14.

When the yarn presence sensor SENS senses that a break has occurred in the continuity of the yarn, it starts the geared motor 16, which rotates the shaft 14 to commence braking. Simultaneously with the starting of the motor 16, the sensor SENS activates the electromagnetic clutch 19, which is in the rest position corresponding to "idle".

The command for the activation of the electromagnetic clutch 19 depends however on the timer 11 which—according to the angle $\alpha$—either allows said command to pass immediately by simultaneously moving the shafts 14 and 17, or allows it to pass after a delay $\Delta T$ by staggering the start of rotation of the shaft 17 relative to the shaft 14.

As a result of this time displacement between the rotation of the shafts 14 and 17, the time left available for braking the bobbin varies.

According to the present invention it is possible to vary the pattern of delays introduced between the two parts of the intervention cycle, by means of a plurality of embodiments. In this respect, it should be noted that as the winding speed increases, the effective time required for halting the bobbin increases, as shown diagrammatically in FIG. 3, and it is therefore necessary to make a longer time available for the first part of the intervention cycle concerned with the braking. A simple method for varying the delay pattern consists of presetting the angular positon of the cam 8 on the bobbin carrier arm 2 at an angle $\beta$, varying from a minimum position a then through b, c and d, to a maximum position e. In passing from the preset position a through the subsequent positions, the pattern of delays fed to the timer is progressively advanced with respective to the variation of $\alpha$ as the steps of the contour 9 are presented to the sensor 10 for ever smaller values of $\alpha$.

Figure 2:
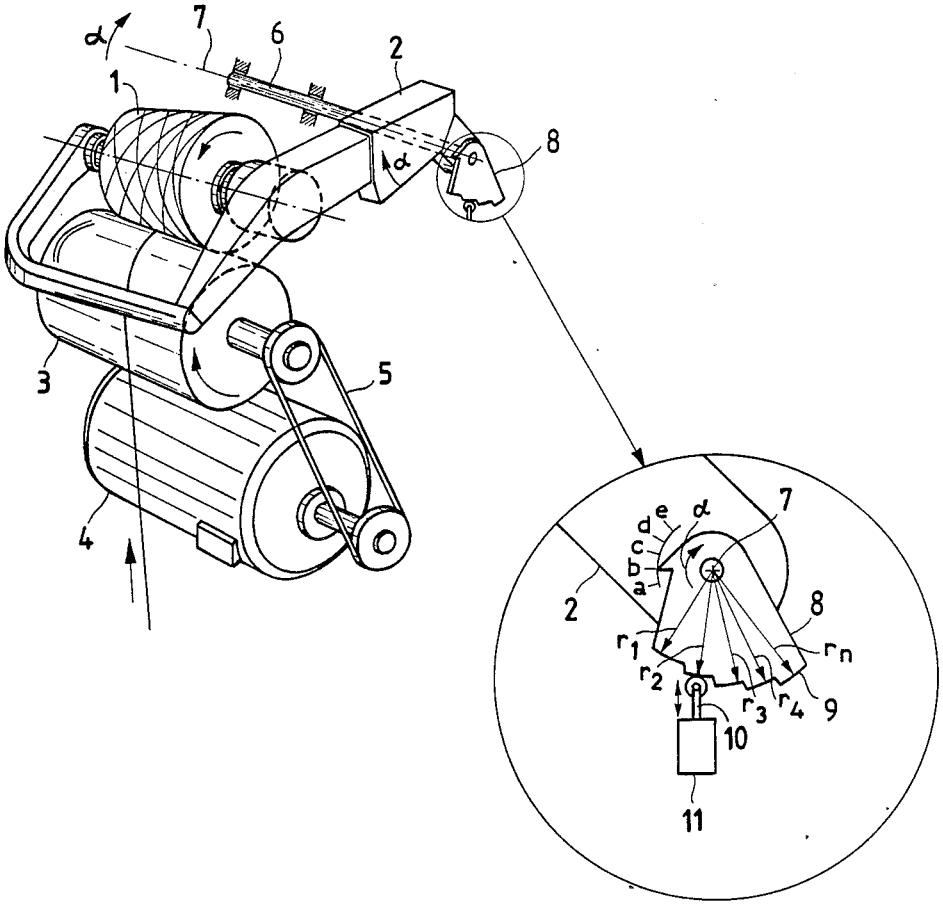
FIG. 2 is an orthogonal diagram of the arrangement of the bobbin carrier arm and the cam positioned on the sensor of the timer.

An equivalent method can comprise displacing the sensor 10 in the plane of FIG. 2.

Another method for varying the delay pattern is to provide a plurality of cams 8 with their contours 9 corresponding to different delay patterns to be used for different winding speeds. Higher speeds require closer steps on the contour 9. These cams can then either be mounted one at a time according to the speed concerned, or can be combined into a "pack" rigid with the bobbin carrier arm 2. In this case the correct cam can be selected by moving the sensor 10 perpendicular to the plane of FIG. 2.

A further variation method is to vary the terms of the series of delays determined by the timer on progressing through the steps of the contour 9. The advantages obtained by the present invention are apparent from the aforegoing description, namely;

the possibility of varying the time left available for bobbin braking means that winding can proceed at higher speeds and/or larger diameter bobbins can be wound without extending said braking time beyond that strictly necessary;

any efficiency loss in the bobbin brakes with the passing of time can be compensated by varying the presetting of the cam 8/sensor 10 system;

the time available for braking the bobbin can be adapted to the variation in the linear winding speed or to other winding parameters by varying the presetting of the cam 8/sensor 10 system.

We claim:

1. A method for winding yarn onto a rotating bobbin held by an arm and driven by a drive roller when the yarn feed is broken, comprising:

(a) restoring the broken yarn feed by means of an intervention cycle wherein said cycle has a first portion and a second portion wherein said first portion comprises the steps of:

(1) raising the rotating bobbin from the drive roller when the yarn feed is broken;

(2) braking the rotating bobbin and the drive roller independently until the bobbin stops rotating; and wherein said second portion comprises joining the broken yarn; and (b) interposing a variable time delay between the commencement of the bobbin braking step of said first portion of said intervention cycle and the commencement of the yarn joining step of said second portion of said intervention cycle, wherein said variable time delay is determined by the amount of yarn wound on the bobbin, wherein said amount of yarn wound on the bobbin is determined by measuring the inclination of the bobbin holder arm.

2. The method of claim 1 wherein said variable time delay comprises a discrete time interval delay wherein said discrete timer interval delay is selected from a plurality of discrete time interval delay values by means of a timer device.

3. The method of claim 2 wherein zero is the first value of said discrete time interval delay values.

4. A device for winding yarn onto a rotating bobbin held by an arm and driven by a drive roller and supported by a carrier arm when yarn feed is broken, comprising:

(a) a bobbin raising means for raising the rotating bobbin from the drive roller when the yarn feed is broken;

(b) a bobbin braking means for braking the rotating bobbin until the bobbin stops rotating;

(c) a drive roller braking means for braking the drive roller independently from said bobbin braking means;

(d) a joining means to join the disconnected yarn; and (e) a timer device for interposing a time interval delay between the commencement of the operation of said bobbin braking means and the commencement of the operation of said joining means wherein said time delay is determined by the amount of yarn wound on the bobbin, and wherein the amount of yarn wound on the bobbin is determined by a means for measuring the inclination of the bobbin holder arm.

5. The device of claim 4 wherein said time interval delay further comprises a discrete time interval delay.

6. The device of claim 5 wherein said timer device selects said discrete time interval delay from a plurality of time interval delay values wherein zero is the first value of said plurality of values.

7. The device of claim 6 further comprising a mechanical sensor connected to the bobbin carrier arm wherein said mechanical sensor comprises:

(a) a cam having a contour wherein said cam is connected to the bobbin carrier arm; and (b) a sensing device in contact with said contour of said cam for operating said timer device.

8. The device of claim 7 wherein said contour of said cam further comprises several portions of substantially constant radius smoothly connected by portions of increasing radius for creating a pattern of time delays.

9. The device of claim 7 wherein said contour of said cam creates a pattern of time delays depending upon the quantity of yarn wound on the bobbin.

10. The device of claim 9 wherein said sensing device is set relative to said cam for creating a varying pattern of time delays depending upon the quantity of yarn wound on the bobbin.

11. The device of claims 6 or 7 wherein said delay pattern is modified by selecting a cma with different contours.

12. The device of claim 11 further comprising:

(a) a first series of cams for controlling the operation of said bobbin raising means, said bobbin braking means, and said drive roller braking means;

(b) a second series of cams for controlling the operation of said joining means and the operation of said timer device;

(c) a first rotary shaft on which said first series of cams is mounted;

(d) a second rotary shaft on which said second series of cams is mounted;

(e) a clutch interposed between said first rotary shaft and said second rotary shaft for allowing the second shaft to either rotate with the first shaft or remain idle with respect thereto;

(f) a motor connected and energized by said sensor for driving the said rotary shaft and said second rotary shaft; and wherein said time device energizes said clutch for engaging said first shaft to said second rotary shaft.

* * * * *